US008007372B2

(12) United States Patent
Long et al.

(10) Patent No.: US 8,007,372 B2
(45) Date of Patent: Aug. 30, 2011

(54) GOLF CLUB HEAD WITH LOCALIZED GROOVES AND REINFORCEMENT

(75) Inventors: D. Clayton Long, Carlsbad, CA (US); G. Thomas Mase, Carlsbad, CA (US)

(73) Assignee: Cobra Golf, Inc., Carlsbad, CA (US)

( * ) Notice: Subject to any disclaimer, the term of this patent is extended or adjusted under 35 U.S.C. 154(b) by 0 days.

(21) Appl. No.: 12/887,173

(22) Filed: Sep. 21, 2010

(65) Prior Publication Data

US 2011/0034272 A1 Feb. 10, 2011

Related U.S. Application Data

(63) Continuation of application No. 10/943,978, filed on Sep. 20, 2004, now abandoned, which is a continuation of application No. 09/551,893, filed on Apr. 19, 2000, now abandoned.

(51) Int. Cl.
*A63B 53/04* (2006.01)

(52) U.S. Cl. ..... 473/342; 473/346; 473/330

(58) Field of Classification Search ..... 473/324–350
See application file for complete search history.

(56) References Cited

U.S. PATENT DOCUMENTS

| | | | |
|---|---|---|---|
| 1,318,325 | A | 10/1919 | Klin |
| 1,319,233 | A | 10/1919 | Mattern |
| 1,467,435 | A | 9/1923 | Kinnear |
| 1,525,352 | A | 2/1925 | Aitken |
| 1,543,691 | A | 6/1925 | Beat |
| 1,582,836 | A | 4/1926 | Link |
| 1,589,363 | A | 6/1926 | Butchart |
| 1,595,589 | A | 8/1926 | Tyler |
| 1,605,551 | A | 11/1926 | Mattern |
| 1,699,874 | A | 1/1929 | Buhrke |
| 1,704,119 | A | 3/1929 | Buhrke |
| 1,704,165 | A | 3/1929 | Buhrke |
| 1,720,867 | A | 7/1929 | Webster et al. |
| 2,034,936 | A | 3/1936 | Barnhart |
| 2,087,685 | A | 7/1937 | Hackney |
| 3,567,228 | A | 3/1971 | Lynn |
| 3,571,900 | A | 3/1971 | Hardesty |
| 3,625,518 | A | 12/1971 | Solheim |
| 3,659,855 | A | 5/1972 | Hardesty |

(Continued)

FOREIGN PATENT DOCUMENTS

CN 1114911 1/1996

(Continued)

OTHER PUBLICATIONS

"Variable Face Thickness Technology," Calloway Golf advertisement, undated.

(Continued)

*Primary Examiner* — Alvin A Hunter
(74) *Attorney, Agent, or Firm* — Knobbe, Martens, Olson & Bear LLP

(57) ABSTRACT

The present invention relates to a golf club head provided with a shell defining an inner cavity and having a face and a body. The face has a first or reinforcement portion with a first thickness and a second or remaining portion with a second thickness less than the first thickness. The reinforcement portion is located at the center of the face. In one embodiment, the exterior surface of the face defines at least one groove spaced from the center of the face.

2 Claims, 3 Drawing Sheets

U.S. PATENT DOCUMENTS

| | | | | |
|---|---|---|---|---|
| 3,863,932 | A | | 2/1975 | Lezatte |
| 3,985,363 | A | | 10/1976 | Jepson et al. |
| 4,023,802 | A | | 5/1977 | Jepson et al. |
| 4,193,601 | A | | 3/1980 | Reid, Jr. et al. |
| 4,213,613 | A | | 7/1980 | Nygren |
| 4,214,754 | A | | 7/1980 | Zebelean |
| D267,965 | S | | 2/1983 | Kobayashi |
| 4,429,879 | A | | 2/1984 | Schmidt |
| 4,449,707 | A | | 5/1984 | Hayashi et al. |
| 4,451,041 | A | | 5/1984 | Hayashi et al. |
| 4,451,042 | A | | 5/1984 | Hayashi et al. |
| 4,465,221 | A | | 8/1984 | Schmidt |
| 4,471,961 | A | | 9/1984 | Masghati et al. |
| 4,489,945 | A | | 12/1984 | Kobayashi |
| 4,511,145 | A | | 4/1985 | Schmidt |
| 4,762,324 | A | | 8/1988 | Anderson |
| 4,792,140 | A | * | 12/1988 | Yamaguchi et al. ..... 473/331 |
| 4,826,172 | A | | 5/1989 | Antonious |
| 4,842,243 | A | | 6/1989 | Butler |
| 4,913,438 | A | | 4/1990 | Anderson |
| 4,915,385 | A | | 4/1990 | Anderson |
| 4,915,386 | A | | 4/1990 | Antonious |
| 4,919,430 | A | | 4/1990 | Antonious |
| 4,919,431 | A | | 4/1990 | Antonious |
| 4,921,252 | A | | 5/1990 | Antonious |
| 4,930,781 | A | | 6/1990 | Allen |
| 4,932,658 | A | | 6/1990 | Antonious |
| 4,955,610 | A | | 9/1990 | Creighton et al. |
| D312,858 | S | | 12/1990 | Anderson et al. |
| 5,000,454 | A | | 3/1991 | Soda |
| 5,024,437 | A | | 6/1991 | Anderson |
| 5,028,049 | A | | 7/1991 | McKeighen |
| 5,046,733 | A | | 9/1991 | Antonious |
| 5,056,705 | A | | 10/1991 | Wakita et al. |
| 5,060,951 | A | | 10/1991 | Allen |
| 5,067,715 | A | | 11/1991 | Schmidt et al. |
| 5,090,702 | A | | 2/1992 | Viste |
| 5,094,383 | A | | 3/1992 | Anderson et al. |
| 5,106,094 | A | | 4/1992 | Desbiolles et al. |
| 5,141,230 | A | | 8/1992 | Antonious |
| 5,163,682 | A | | 11/1992 | Schmidt et al. |
| 5,180,166 | A | | 1/1993 | Schmidt et al. |
| 5,183,255 | A | | 2/1993 | Antonious |
| 5,213,328 | A | | 5/1993 | Long et al. |
| 5,221,087 | A | | 6/1993 | Fenton et al. |
| 5,240,252 | A | | 8/1993 | Schmidt et al. |
| 5,242,167 | A | | 9/1993 | Antonious |
| 5,255,918 | A | | 10/1993 | Anderson et al. |
| 5,261,663 | A | | 11/1993 | Anderson |
| 5,261,664 | A | | 11/1993 | Anderson |
| 5,271,621 | A | | 12/1993 | Lo |
| 5,292,129 | A | | 3/1994 | Long et al. |
| 5,295,689 | A | | 3/1994 | Lundberg |
| 5,301,945 | A | | 4/1994 | Schmidt et al. |
| 5,318,300 | A | | 6/1994 | Schmidt et al. |
| 5,328,184 | A | | 7/1994 | Antonious |
| 5,344,140 | A | | 9/1994 | Anderson |
| 5,346,218 | A | | 9/1994 | Wyte |
| 5,351,958 | A | | 10/1994 | Helmstetter |
| 5,358,249 | A | | 10/1994 | Mendralla |
| 5,362,047 | A | | 11/1994 | Shaw et al. |
| 5,362,055 | A | | 11/1994 | Rennie |
| 5,390,924 | A | | 2/1995 | Antonious |
| 5,395,113 | A | | 3/1995 | Antonious |
| 5,397,126 | A | | 3/1995 | Allen |
| 5,397,127 | A | | 3/1995 | Kawada et al. |
| 5,401,021 | A | | 3/1995 | Allen |
| 5,405,137 | A | | 4/1995 | Vincent et al. |
| 5,407,202 | A | | 4/1995 | Igarashi |
| RE34,925 | E | | 5/1995 | McKeighen |
| 5,417,419 | A | | 5/1995 | Anderson et al. |
| 5,417,559 | A | | 5/1995 | Schmidt |
| 5,423,535 | A | | 6/1995 | Shaw et al. |
| 5,429,357 | A | | 7/1995 | Kobayashi |
| 5,431,396 | A | | 7/1995 | Shieh |
| 5,433,440 | A | | 7/1995 | Lin |
| 5,437,088 | A | | 8/1995 | Igarashi |
| 5,447,307 | A | | 9/1995 | Antonious |
| 5,447,309 | A | | 9/1995 | Vincent |
| 5,451,056 | A | | 9/1995 | Manning |
| 5,460,376 | A | | 10/1995 | Schmidt et al. |
| 5,467,983 | A | | 11/1995 | Chen |
| 5,470,069 | A | | 11/1995 | Schmidt et al. |
| 5,474,296 | A | | 12/1995 | Schmidt et al. |
| 5,482,279 | A | | 1/1996 | Antonious |
| 5,497,993 | A | | 3/1996 | Shan |
| 5,505,450 | A | | 4/1996 | Stuff |
| 5,505,453 | A | | 4/1996 | Mack |
| 5,522,593 | A | | 6/1996 | Kobayashi et al. |
| 5,524,331 | A | | 6/1996 | Pond |
| 5,527,034 | A | | 6/1996 | Ashcraft et al. |
| 5,533,729 | A | | 7/1996 | Leu |
| 5,536,006 | A | | 7/1996 | Shieh |
| 5,547,630 | A | | 8/1996 | Schmidt |
| 5,549,297 | A | | 8/1996 | Mahaffey |
| 5,564,994 | A | | 10/1996 | Chang |
| 5,584,770 | A | | 12/1996 | Jensen |
| 5,595,552 | A | | 1/1997 | Wright et al. |
| 5,611,741 | A | | 3/1997 | Schmidt et al. |
| 5,611,742 | A | | 3/1997 | Kobayashi |
| 5,620,382 | A | * | 4/1997 | Cho et al. ..... 473/331 |
| D379,393 | S | | 5/1997 | Kubica et al. |
| 5,626,530 | A | | 5/1997 | Schmidt et al. |
| 5,643,104 | A | | 7/1997 | Antonious |
| 5,643,108 | A | | 7/1997 | Cheng |
| 5,643,110 | A | | 7/1997 | Igarashi |
| 5,649,872 | A | | 7/1997 | Antonious |
| 5,651,409 | A | | 7/1997 | Sheehan |
| 5,655,976 | A | | 8/1997 | Rife |
| 5,669,827 | A | | 9/1997 | Nagamoto |
| 5,669,829 | A | | 9/1997 | Lin |
| D387,113 | S | | 12/1997 | Burrows |
| 5,695,411 | A | | 12/1997 | Wright et al. |
| 5,697,855 | A | * | 12/1997 | Aizawa ..... 473/350 |
| 5,709,614 | A | | 1/1998 | Horiba |
| 5,709,615 | A | | 1/1998 | Liang |
| 5,709,617 | A | * | 1/1998 | Nishimura et al. ..... 473/330 |
| 5,711,722 | A | | 1/1998 | Miyajima et al. |
| 5,716,292 | A | | 2/1998 | Huang |
| 5,718,641 | A | | 2/1998 | Lin |
| 5,720,673 | A | | 2/1998 | Anderson |
| 5,743,813 | A | | 4/1998 | Chen et al. |
| 5,753,170 | A | | 5/1998 | Muang |
| 5,755,624 | A | | 5/1998 | Helmstetter |
| 5,755,627 | A | | 5/1998 | Yamazaki et al. |
| 5,762,567 | A | | 6/1998 | Antonious |
| 5,766,092 | A | | 6/1998 | Mimeur et al. |
| 5,766,094 | A | | 6/1998 | Mahaffey et al. |
| 5,766,095 | A | | 6/1998 | Antonious |
| 5,776,011 | A | | 7/1998 | Su et al. |
| 5,797,807 | A | | 8/1998 | Moore |
| 5,800,285 | A | * | 9/1998 | Thorne et al. ..... 473/324 |
| 5,807,190 | A | | 9/1998 | Krumme et al. |
| 5,827,132 | A | | 10/1998 | Bamber |
| RE35,955 | E | | 11/1998 | Lu |
| D401,652 | S | | 11/1998 | Burrows |
| 5,830,084 | A | | 11/1998 | Kosmatka |
| 5,839,975 | A | | 11/1998 | Lundberg |
| 5,842,934 | A | | 12/1998 | Ezaki et al. |
| 5,851,159 | A | | 12/1998 | Burrows |
| 5,863,261 | A | | 1/1999 | Eggiman |
| 5,873,791 | A | | 2/1999 | Allen |
| 5,873,795 | A | | 2/1999 | Wozny et al. |
| D406,294 | S | | 3/1999 | Burrows |
| 5,888,148 | A | | 3/1999 | Allen |
| 5,890,973 | A | | 4/1999 | Gamble |
| D411,272 | S | | 6/1999 | Burrows |
| 5,908,357 | A | | 6/1999 | Hsieh |
| 5,921,872 | A | | 7/1999 | Kobayashi |
| 5,931,746 | A | | 8/1999 | Soong |
| 5,935,019 | A | | 8/1999 | Yamamoto |
| 5,938,541 | A | | 8/1999 | Allen et al. |
| 5,954,596 | A | | 9/1999 | Noble et al. |
| 5,961,394 | A | | 10/1999 | Minabe |
| 5,967,905 | A | | 10/1999 | Nakahara et al. |
| 5,971,868 | A | | 10/1999 | Kosmatka |
| 6,089,992 | A | * | 7/2000 | Onuki et al. ..... 473/324 |

| | | | | |
|---|---|---|---|---|
| 6,224,497 | B1 * | 5/2001 | Antonious | 473/330 |
| 6,248,025 | B1 | 6/2001 | Murphy et al. | |
| 6,338,683 | B1 | 1/2002 | Kosmatka | |
| 6,354,962 | B1 * | 3/2002 | Galloway et al. | 473/342 |
| 6,428,426 | B1 * | 8/2002 | Helmstetter et al. | 473/330 |
| 6,428,427 | B1 * | 8/2002 | Kosmatka | 473/349 |
| 6,443,856 | B1 | 9/2002 | Galloway et al. | |
| 6,575,845 | B2 * | 6/2003 | Galloway et al. | 473/329 |
| 6,582,323 | B2 * | 6/2003 | Soracco et al. | 473/342 |
| 6,602,150 | B1 * | 8/2003 | Kosmatka | 473/342 |
| 6,605,007 | B1 | 8/2003 | Bissonnette et al. | |
| 6,623,377 | B2 * | 9/2003 | Evans et al. | 473/342 |
| 6,663,504 | B2 * | 12/2003 | Hocknell et al. | 473/329 |
| 6,824,475 | B2 * | 11/2004 | Burnett et al. | 473/329 |
| 6,863,626 | B2 * | 3/2005 | Evans et al. | 473/342 |
| 6,966,848 | B2 * | 11/2005 | Kusumoto | 473/342 |
| 7,014,570 | B2 * | 3/2006 | Evans et al. | 473/329 |
| 7,018,303 | B2 | 3/2006 | Yamamoto | |
| 7,220,190 | B2 * | 5/2007 | Hirano | 473/342 |
| 7,384,348 | B2 * | 6/2008 | Lin et al. | 473/332 |
| 7,387,579 | B2 * | 6/2008 | Lin et al. | 473/332 |
| 7,682,262 | B2 * | 3/2010 | Soracco et al. | 473/329 |
| 7,753,808 | B2 * | 7/2010 | Matsunaga | 473/342 |
| 2003/0064823 | A1 | 4/2003 | Yamamoto | |

FOREIGN PATENT DOCUMENTS

| | | | |
|---|---|---|---|
| EP | 0484931 | | 5/1992 |
| GB | 2268693 | | 1/1994 |
| GB | 2331938 | | 6/1999 |
| JP | 59207169 | | 11/1984 |
| JP | 61033682 | | 2/1986 |
| JP | 61162967 | | 7/1986 |
| JP | 61181477 | | 8/1986 |
| JP | 61185281 | | 8/1986 |
| JP | 61240977 | | 10/1986 |
| JP | 1244770 | | 9/1989 |
| JP | 4020357 | | 1/1992 |
| JP | 4327864 | | 11/1992 |
| JP | 5212526 | | 8/1993 |
| JP | 6007487 | | 1/1994 |
| JP | 6114126 | | 4/1994 |
| JP | 6126002 | | 5/1994 |
| JP | 6154367 | | 6/1994 |
| JP | 6182005 | | 7/1994 |
| JP | 6269518 | | 9/1994 |
| JP | 08164229 | A * | 6/1996 |
| JP | 8168541 | | 7/1996 |
| JP | 8243194 | | 9/1996 |
| JP | 8280853 | | 10/1996 |
| JP | 8280854 | | 10/1996 |
| JP | 8294550 | | 11/1996 |
| JP | 9028842 | | 2/1997 |
| JP | 9047531 | | 2/1997 |
| JP | 9154985 | | 6/1997 |
| JP | 9168613 | | 6/1997 |
| JP | 09168613 | A * | 6/1997 |
| JP | 9192270 | | 7/1997 |
| JP | 9192273 | | 7/1997 |
| JP | 9239074 | | 9/1997 |
| JP | 9239075 | | 9/1997 |
| JP | 9248353 | | 9/1997 |
| JP | 09253243 | A * | 9/1997 |
| JP | 9294833 | | 11/1997 |
| JP | 9299519 | | 11/1997 |
| JP | 09322952 | A * | 12/1997 |
| JP | 10024126 | | 1/1998 |
| JP | 10024128 | | 1/1998 |
| JP | 2717759 | | 2/1998 |
| JP | 10085369 | | 4/1998 |
| JP | 10118227 | | 5/1998 |
| JP | 10137372 | | 5/1998 |
| JP | 10155943 | | 6/1998 |
| JP | 10258142 | | 9/1998 |
| JP | 10263121 | | 10/1998 |
| JP | 10323410 | | 12/1998 |
| JP | 10337347 | | 12/1998 |
| JP | 2880109 | | 4/1999 |
| JP | 11169493 | A * | 6/1999 |
| JP | 11299938 | A * | 11/1999 |
| JP | 2000296190 | A * | 10/2000 |
| JP | 2001161868 | A * | 6/2001 |
| JP | 2002-191727 | | 7/2002 |
| JP | 2003-210623 | | 7/2003 |
| JP | 2003339921 | A * | 12/2003 |
| JP | 2004-135963 | | 5/2004 |
| JP | 2004-187795 | | 7/2004 |
| JP | 2004-222905 | | 8/2004 |
| JP | 2004329544 | A * | 11/2004 |
| JP | 2006043460 | A * | 2/2006 |
| JP | 2006087928 | A * | 4/2006 |
| JP | 2007007276 | A * | 1/2007 |

OTHER PUBLICATIONS

Golf Digest, vol. 32, No. 12, Dec. 1981, in 7 pages.

Golf Digest, vol. 33. No. 9, Sep. 1982, in 4 pages.

Japanese Office Action for Japanes Application No. 2005-272264, dated Aug. 21, 2007, in 7 pages.

Japanese Office Action for Japanese Application No. 2005-272264, dated Mar. 25, 2008, in 9 pages.

* cited by examiner

GOLF CLUB HEAD WITH LOCALIZED GROOVES AND REINFORCEMENT

This application is a continuation of U.S. patent application Ser. No. 10/943,978, filed Sep. 20, 2004, which is a continuation of U.S. patent application Ser. No. 09/551,893, filed Apr. 19, 2000, each of which is incorporated by reference herein in its entirety.

FIELD OF THE INVENTION

The invention relates to a golf club head. More particularly, the invention is related to a golf club head with a face provided with localized grooves on the exterior of the face and a reinforced central region on the interior of the face.

BACKGROUND OF THE INVENTION

The complexities of golf club design are well-known. The choice of specifications for each component of the club (i.e., the club head, shaft, hosel, grip, and subcomponents thereof) directly impacts the performance of the club. Thus, by varying the design specifications, a golf club can be tailored to desired performance characteristics.

The design of club heads has long been studied. Among the more prominent considerations in club head design are loft, lie, face angle, horizontal face bulge, vertical face roll, face progression, sole curvature, center of gravity location, and overall head weight. While this basic set of criteria is generally the focus of golf club engineering, several other considerations must also be addressed. The interior design of the club head may be tailored to achieve particular characteristics, such as by including hosel or shaft attachment means, perimeter weighting on the face or body of the club head, and fillers within hollow club heads. The choice of materials for manufacture of the club head, must also be considered.

The type of surface treatment on the outer surface of the face is an additional design consideration. The United States Golf Association (USGA), the organization that sets the rules of golf in the United States, has instituted a rule that prohibits the competitive use in any USGA sanctioned event of a golf club where the surface roughness within an impact area of the face exceeds that of decorative sandblasting or fine milling. To spite this rule, it is widely known that many players create a roughened club head face, in order to obtain a greater backspin on their shots.

Additionally, faces are traditionally provided with stria or grooves, at regularly spaced intervals on the surface. The grooves are usually parallel, and must conform to standards established by the USGA covering groove cross-sectional symmetry, groove edge roundness, distance between adjacent grooves, and groove depth.

Various theories have been advanced to either explain or dismiss the importance and influence of grooves. The physical influence of the groove on ball trajectory, for example, may be partly attributed to the momentary deformation of the golf ball cover into the groove upon impact. This deformation is dictated by the modulus of elasticity of the golf ball cover material. Grooves are generally credited with providing large-scale, or macro-roughening on the club head face, thereby increasing back spin. Grooves in the club face may also assist a player in club alignment at address. While the degree of influence of club facial grooves on ball trajectory is disputed, grooves are largely recognized as a meaningful consideration in club head design.

The designs for golf club heads also must be strong enough to withstand the impact forces that occur due to contact between the head and the ball. The loading that occurs during this brief impact can confer an acceleration to the golf ball that is 20,000 times the acceleration of gravity, which is about four orders of magnitude greater than that of gravity. Thus, the club face and body should be designed to resist permanent deformations or catastrophic failure, such as by cracking.

It is not unusual for the club heads of prior art woods to have a face thickness exceeding 0.12 inch. This thickness has typically been required so that the club head face can withstand the impact forces. The faces of irons must also withstand considerable stresses, and as disclosed in U.S. Pat. No. 5,971,868 to Kosmatka. Thus, the faces of irons may be provided with a contoured back surface to provide increased structural integrity. Nevertheless, the design of hollow woods presents distinctly different challenges from irons, particularly due to the cavities defined within hollow woods. Whether produced by investment casting, molding, or otherwise, woods are subjected to different manufacturing stresses, and different performance requirements than irons.

The thickness of the club head face impacts various club head parameters, including the overall weight of the club head, the rigidity of the face, the vibration characteristics of the club head, the sound produced upon impact of the face with a ball, and the location of the center of gravity of the club head. In some club heads, it is desirable to minimize face thickness. Any decrease in thickness, however, must be compensated for by adjusting other design considerations. Such adjustments may include the provision of other structural features on the back surface of the club face, or the inner surface of the club head shell. Another optional adjustment includes the use of a filler material in the shell. Furthermore, the overall construction of the club head may be adjusted, such as by using a face plate insert that is fit to a club head shell, by welding, soldering or other means. Alternatively, the face plate insert may be integrally formed with the shell.

Particularly during casting of a club head, it is difficult to repeatedly produce the desired shape to a tight dimensional tolerance. However, the performance of a golf club head, particularly a metal wood, is in part a function of the proper shape and size of the club face. One especially vexing problem encountered during casting of prior art club heads is that the club head face, which is initially cast with a generally convex exterior surface, upon cooling often collapses inward and fails to retain the desired shape. Such a problem may be exacerbated in club heads with thin faces.

Thus, there is a need for a golf club head that can be consistently manufactured with a desired club head shape and size, and has a face that can withstand the impact stresses encountered during ball striking. More particularly, there is a need for a club head with a thin face that performs well. Additionally, there is a need for a club head that minimizes the degree of backspin imparted to a golf ball.

SUMMARY OF THE INVENTION

The present invention relates to a golf club head adapted for attachment to a shaft. The head includes a shell that defines an inner cavity. The shell includes a face and a body. The face has an exterior surface and an interior surface. Grooves are formed on the exterior surface of the face offset from the sweet spot or center of the face.

Preferably, a localized reinforcement portion is provided on the interior surface of the face at the sweet spot or center. As a result, the face has two portions with different thicknesses. The localized reinforcement portion has a first thickness greater than the second thickness of the remaining portion of the face. The second portion surrounding the first portion has a second thickness less than or equal to about 0.12 inches, and the first thickness is greater than the second thickness. A grooveless region on the exterior of the face comprises at least 25% of the face area including the center thereof. Preferably, grooves do not extend across the exterior surface of the face at the localized reinforcement portion, and the grooves bound an area less than or equal to about 50% of an area of the face. The grooves preferably are spaced from the center of the face at least 0.375 inches in any direction.

In one embodiment, the first thickness or thickness of the reinforcement portion is greater than or equal to about 0.08 inches and less than or equal to about 0.12 inches. The second thickness is less than or equal to about 0.12 inches and more preferably less than or equal to about 0.08 inches. Most preferably the second thickness is less than or equal to about 0.06 inches. The first thickness can be uniform or varied across the reinforcement portion. The first portion and second portion are formed of the same material. At least one groove preferably extends substantially between a toe end and a heel end of the golf club In another embodiment, the localized reinforcement portion has an area between about 10% to about 90% of the face area. Preferably, the reinforcement portion area is less than about 15% of the face area. In yet another embodiment, the area of the localized reinforcement portion is less than about 25% of the face area. Preferably, the shell of the club head has a crown plate, a sole plate, the face, and a hosel, with the sole plate formed integral with the shell. Alternatively, the crown plate is formed integral with the shell.

The present invention is also directed to a golf club head adapted for attachment to a shaft that includes a shell that defines an inner cavity. The shell further includes a face with first and second portions. The first portion is in the center of the face and has a first thickness. The second portion has a second thickness less than or equal to about 0.12 inches. The first thickness is greater than the second thickness. In addition, the face has an exterior surface with a substantially smooth portion having an area greater than about 25% of an area of the face. Preferably, the smooth portion is in the center of the face and is the part that lacks grooves. The smooth portion includes at least a portion of the first portion.

The present invention is also related to a method of forming a golf club head comprising the steps of forming a shell defining an inner cavity with a face and a body. The step of forming the shell includes the steps of: forming the face with a first portion of the face in the center of the face and having a first thickness, and a second portion surrounding the first portion and having a second thickness less than or equal to about 0.12, with the first thickness being greater than the second thickness; and forming grooves in the face spaced from the center. Preferably, the step of forming the shell further includes casting the first portion simultaneously with the face. Alternatively, the step of forming the shell includes casting the first portion separate from the face and subsequently coupling the first portion to the face. In one embodiment, the face is stamped. In another embodiment, the face is engraved.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION OF THE PREFERRED EMBODIMENT

Figure 1:
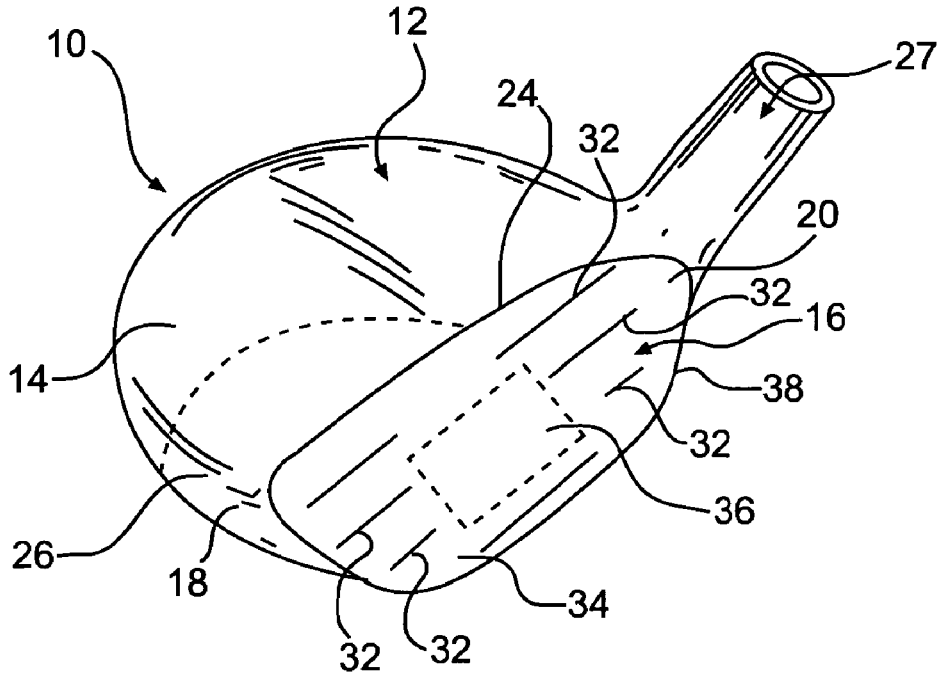
FIG. 1 shows a front, perspective view of a first embodiment of a golf club head of the present invention.
Figure 2:
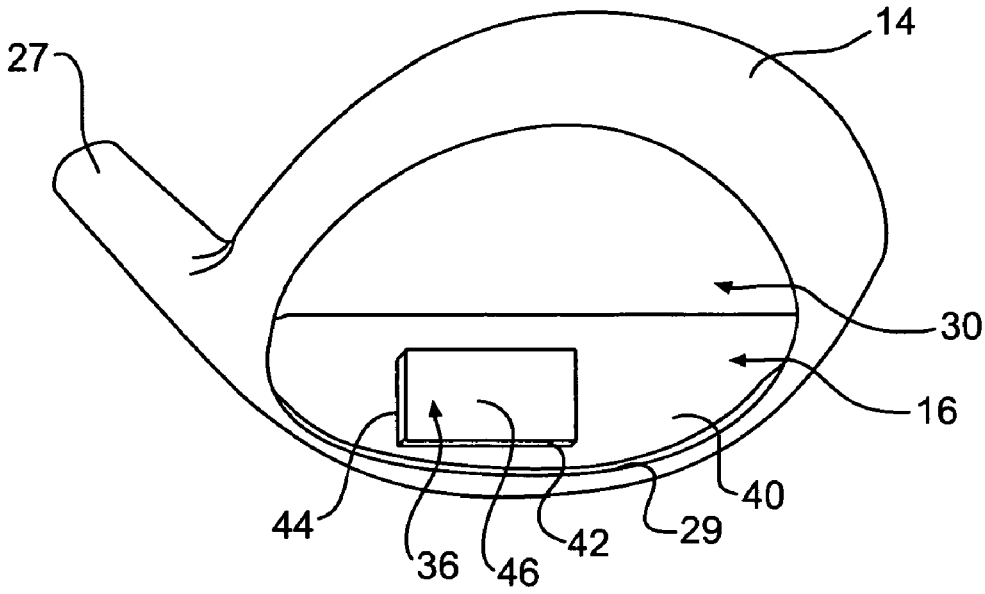
FIG. 2 shows a bottom, perspective view of the golf club head of FIG. 1 with a sole plate removed.

With reference to FIGS. 1 and 2, a first embodiment of a golf club head 10 of the present invention is shown. Club head 10 includes shell 12 with a body 14, face 16, toe portion 18, heel portion 20, and top portion 24. The head 10 further includes a sole plate 26 (shown in phantom), hosel 27, and top portion 24. The sole plate 26 fits in a recess 29 defined in the body 14. The shell 12 and sole plate 26 create an inner cavity 30. The face 16 is preferably provided with grooves 32 on its exterior surface 34. In a preferred embodiment, at least one groove 32 extends substantially between toe portion 18 and heel portion 20.

During use, a golf club shaft (not shown) is attached at hosel 27. The hosel may extend to the bottom of the club head, may terminate at a location intermediate the top portion 27 and sole plate 26, or the hosel 27 may terminate at the top portion 24 of the head.

Inner cavity 30 of club head 10 may be empty, or alternatively may be filled with a foam or other low specific gravity material. Preferably, the shell is entirely cast, or at least face 16 is formed from a higher strength alloy than body 14. More preferably, shell 12 is formed so that the body 14 and face 16 may be combined to be integral, such as by welding, thus forming a homogeneous shell.

In an alternate embodiment, shell 12 has a body 14, face 16, toe portion 18, heel portion 20, sole plate 26, and hosel 27. The sole plate is formed integral with shell 12. In this embodiment, a separate crown plate (not shown) is fitted to shell 12, thereby creating the hollow, inner cavity. The crown plate may alternatively be formed integral with the shell.

In a preferred embodiment, face 16 is cold forged or stamped from as-rolled sheet stock of high strength SP-700 titanium alloy (Ti-4.5% AI-3% V-2% Mo-2% Fe).

Alternatively, face 16 is formed of a high strength forging titanium alloy such as 10-2-3 (Ti-10% V-2% Fe-3% AI) or 15-3-3-3 (Ti-15% V-3% Cr-3% Sn-3% AI). Body 14 along with sole plate 26 or a crown plate are produced from a different titanium alloy from that of face 16, preferably by casting a 6-4 alloy (Ti-6% Al-4% V).

Referring to FIG. 2, localized reinforcement portion 36 is provided in a central region of an interior surface 40 of face 16. In a preferred embodiment, the reinforcement portion 36 is formed of additional material that may be integrally cast as part of the face 16, or formed as a separate piece affixed to the face 16 by other means, such as welding and the like. The reinforcement portion 36 is preferably made of the same material as the shell 12 to facilitate casting, or to facilitate bonding to interior surface 40. Alternatively, the reinforcement portion 36 may be made of a different material. Preferably, reinforcement portion 36 has a rectangular perimeter. In an alternate embodiment, reinforcement portion 36 may have any other shaped perimeter, such as an arcuate shape perimeter or re-entrant shapes. Reinforcement portion 36 may also have a shape that follows another geometrical pattern or contour, and may be symmetrical or asymmetrical.

Figure 3:
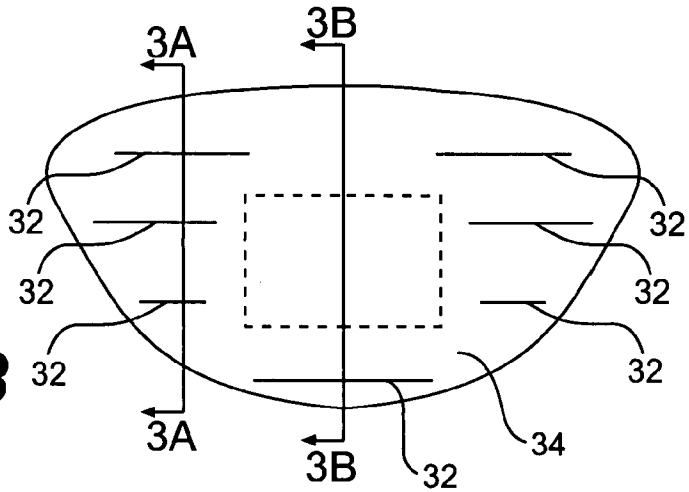
FIG. 3 shows a front view of a first embodiment of a face of the golf club head of FIG. 1.
Figure 3B:
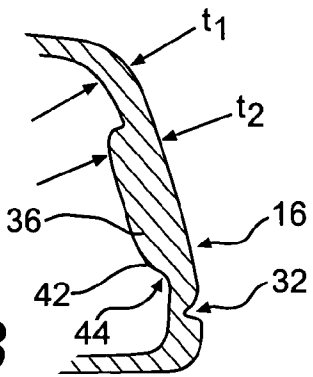
FIG. 3B shows a cross-sectional view the face of FIG. 3 along line 3B-3B.

Referring to FIG. 3B, in the preferred embodiment, sides 42 of reinforcement portion 36 lie generally perpendicular with respect to the interior surface 40 of face 16. It is also contemplated that the interfacial edges defined at lower lines of transition 44 of face 16 and reinforcement portion 36 may have an irregular or sloping profile. Other profiles for sides 42 may be employed, including a gradual or stepped slope from top surface 46 of reinforcement portion 36 to the lower lines of transition 44.

It is recommended that reinforcement portion 36 has an area that is between about 10% and about 90% of the interior surface area 40 or face area. The interior surface and exterior face areas are substantially the same. However, in an embodiment where they vary, either can be used as a comparison to the reinforcement area. In a preferred embodiment, the reinforcement area is approximately about 25% of the face area. Most preferably, the reinforcement area is about 15% of the face area.

Figure 3A:
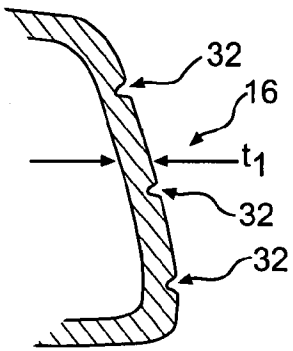
FIG. 3A shows a cross-sectional view through the face of FIG. 3 along line 3A-3A.

Referring to FIGS. 3A and 3B, the reinforcement portion 36 has a thickness t2 greater than the thickness t1 of the remainder of the face 16. The thicknesses t1 and t2 are the maximum thicknesses of the respective areas, because thickness varies at grooves 32 to a minimum. It is preferred that the reinforcement thickness t2 is between about 0.08 inches and about 0.12 inches. The thicknesses $t_1$ and t2 can be uniform or varied. It is preferred that the thickness tt of the remaining portion of the face surrounding the reinforcement portion 36 is less than about 0.12 inches, more preferably less than about 0.08 inches, and most preferably less than 0.06 inches.

Reinforcement portion 36 is provided at or aligned with a sweet spot or the center of face 16, as defined below, where impact forces are expected to be greatest. This permits a thinner face 16 to be used, as compared with a non-reinforced design. The reinforcement distributes the stresses such that the structural integrity of face 16 is sound.

The sweet spot is generally defined, in mechanical terms, as the intersection of a longitudinal line passing through the center of gravity and the face 16. The center of the face includes the sweet spot, but refers to a larger area of the face. The center is a portion of the face that can be defined and still be surrounded on all four sides with a remaining portion of the face without the reinforcement portion. Thus, the reinforcement portion can be located aligned with the sweet spot or more generally in the center of the face.

Preferably, the horizontal projection of the center of gravity intersects the face 16 in the reinforcement portion 36, the thickened region of the club face. More preferably, the intersection of the horizontal projection of the center of gravity with the face is located substantially in the center of reinforcement portion 36.

As shown in FIG. 3, the grooves 32 on external surface 34 of face 16 are provided in localized areas surrounding the sweet spot or center. The grooves, also referred to as corrugation, are formed by scoring, engraving, cutting, stamping, or casting the shapes into the head face. Preferably, the face is stamped and/or engraved. In a preferred embodiment, the grooves 32 on the exterior surface 34 are V-shaped (as best shown in FIGS. 3A and 3B). In an alternate embodiment, the grooves are another shape, such as square or V-shaped. The grooveless portion of the club face is at least about 25% of the face area. Preferably, the grooveless portion includes the area at the center of the face. Also, the grooves are preferably offset from and do not extend across the reinforcement portion, while covering an area less than or equal to about 50% of the face area. In a preferred embodiment, at least one groove is spaced at least 0.375 inch from the center of the face in any direction. A circle with a diameter of 0.75 inch, free of grooves, may for example be formed at the center of the face.

Figure 4:
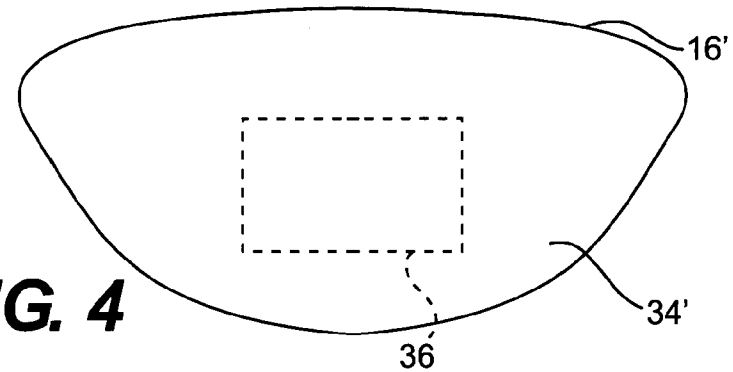
FIG. 4 shows a front view of a second embodiment of the face of the golf club head of the present invention.

FIG. 4 shows an alternate embodiment of a face 16' for use with the club head 10 (as shown in FIG. 1) of the present development. The face 16' lacks grooves (as shown in FIG. 1). This "grooveless" face 16' preferably has an extremely smooth external surface 34', as can be achieved with grinding and polishing techniques known in the art. Such a grooveless surface may be effective in minimizing the degree of back spin imparted to a golf ball upon impact with the club face 16', thus reducing the tendency of a ball that has been hit from a non-central part of face 16' to hook or slice. The lack of grooves may also provide an additional benefit of giving a golfer enhanced control of the trajectory of a golf ball upon impact, as well as increased roll. Thus, a golfer may be able to achieve a longer distance shot for a given club with grooveless faces as compared to grooved or partially grooved faces. The face 16' has the reinforcement portion 36 (as shown in phantom), as discussed above.

It should be noted that the lack of grooves 32 in the sweet spot or central area of face 16 (as shown in FIG. 1) confers a similar benefit as the completely grooveless head faces described above. The provision of localized grooves 32, as shown for example in FIG. 3, in some instances may provide more desirable ball flight on the course following misaligned shots. This is due to the limited gripping interaction of the groove with the surface of the ball, or limited deformation of the ball within the groove.

The design of a club head may be evaluated using computational techniques, which can include the use of finite element analysis models. When computer modeling club heads, a mass of 200 grams was maintained by adjusting the value of the point masses as the thickness of the face changed. Facial stresses were determined assuming a 109 mph club head speed, and such stresses may be used to evaluate face integrity. Also of interest in the design of the club head is the coefficient of restitution (COR), which is the ratio of the velocity of separation to the velocity of approach. In this model, therefore, COR was determined using the following formula:

$$(v_{ball\text{-}post}-v_{club\text{-}post})/v_{club\text{-}pre}$$

where, $v_{ball\text{-}post}$ represents the velocity of the ball after impact;

$v_{club\text{-}post}$ represents the velocity of the club after impact; and $v_{club\text{-}pre}$ represents the velocity of the club before impact.

The COR, in general, depends on the shape and material properties of the colliding bodies. A perfectly elastic impact has a COR of one (1), indicating that no energy is lost, while a perfectly inelastic or plastic impact has a COR of zero, indicating that the colliding bodies did not separate after impact resulting in a maximum loss of energy.

Figure 5:
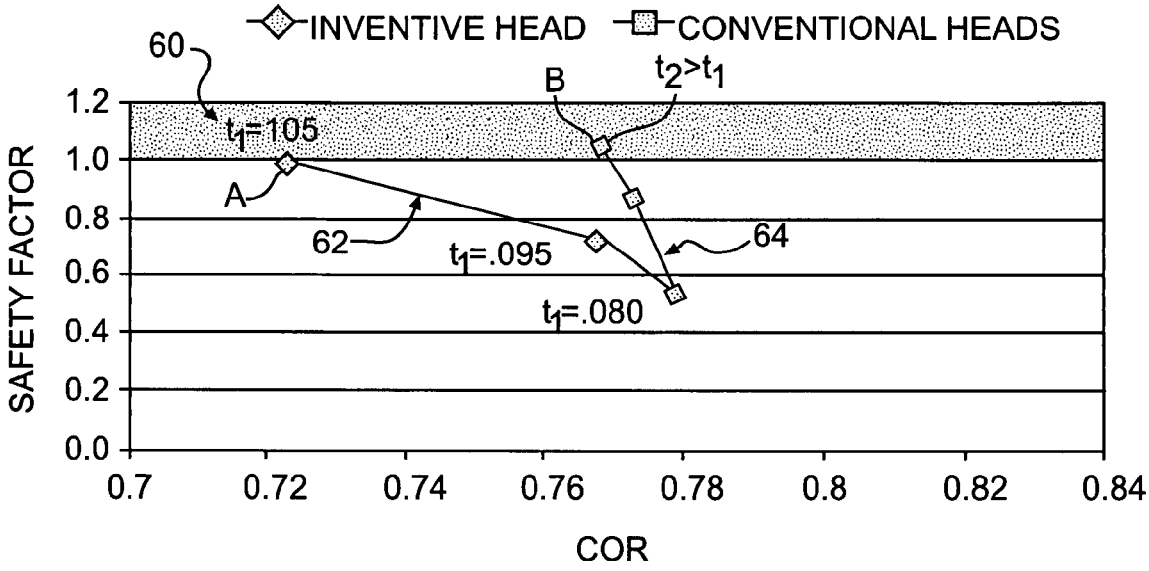
FIG. 5 shows a plot of safety factor as a function of COR for various faces of uniform and non-uniform thickness.

Referring to FIG. 5, the design of club heads was investigated by using a two-parameter design space consisting of the COR and maximum stress or a safety factor. By performing iterative calculations within this space, it was possible to approach the target COR of 0.829 (for a relative velocity of 160 ft/sec), while still having a safety factor greater than 1. The target COR corresponds to the regulated value established by the USGA. A club head exhibiting a safety factor above 1.0 is the minimum design whose face will not cave-in during use. Club heads with data points within the shaded area 60 have a safety factor above 1.0, and therefore are acceptable.

Line 62 has points that represent Conventional Club Heads with different face thickness $t_1$. Line 62 shows that as thickness increases from 0.80 inches to 0.105 inches COR decreases. The club head represented by point A exhibits a safety factor of 1.0 and therefore is acceptable. The club head at point A has a face thickness of 0.105 inches. The club head at point A has a COR of about 0.72 for the considered club head.

Line 64 represents Inventive Club Heads with a central reinforcement portion so that the club head at point B had a reinforcement thickness greater than remaining face thickness t 1, as discussed above. The club head represented by point B exhibits a safety factor of greater than 1.0, therefore the point B is within the shaded or acceptable area 60. The club head at point B has a COR of about 0.77, which is greater than the COR for the club head at point A.

TEST

| Examples | Face Thickness Description | Thickness Value(s) | Percent of Regulated COR | COR |
|---|---|---|---|---|
| Comparative Club 1 | Uniform | 0.08 inches | 104% | 0.862 |
| Comparative Club 2 | Uniform | 0.09 inches | 101.3% | 0.840 |
| Comparative Club 3 | Uniform | 0.10 inches | 98.7% | 0.818 |

Drivers (Comparative Club 1, Comparative Club 2, and Comparative Club 3) were produced having uniform face thicknesses of 0.08 inches, 0.09 inches and 0.10 inches, respectively. A robot manufactured by True Temper and called Iron Byron was used to test these clubs.

COR values for Comparative Club I, Comparative Club 2 and Comparative Club 3 were 104%, 101.3% and 98.7% of regulated value, respectively. Thus, as thickness increased from Club 1 to Club 3, COR decreased undesirably. Comparative Club 1 and Comparative Club 2 both exhibited face collapse under the testing conditions (i.e., a swing speed of 109 mph). Thus, Comparative Club 1 and Comparative Club 2 are unacceptable.

An Inventive Club has a 1.2 inch by 0.9 inch reinforcement portion at the center. The reinforcement thickness t2 is 0.12 inches. The thickness of the remaining portion is 0.08 inches. Computer modeling confirmed that the Inventive Club has reduced stress in the face center compared to uniform thickness conventional clubs. The thickness $t_1$ may be further adjusted to account for off-center hits, possibly decreasing COR.

Advantageously, the use of a reinforcement portion, such as with the Inventive Club, allows an acceptable COR to be obtained with a club head that exhibits superior behavior under stress when compared, for example, to Comparative Club 3. In addition, a portion of the face of such an Inventive Club has a substantially smaller thickness than permitted by acceptable uniform face thickness clubs, such as Comparative Club 3.

While various descriptions of the present invention are described above, it should be understood that the various features of each embodiment can be used singly or in any combination thereof. Therefore, this invention is not to be limited to only the specifically preferred embodiments depicted herein. Further, it should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A golf club head comprising:

a shell defining an inner cavity, the shell comprising a crown, a sole, a skirt, and a face, wherein the face comprises:

a first portion having a first perimeter, the first perimeter encompassing a center of the face;

a separate piece of reinforcing material affixed to a back side of the first portion, the separate piece of reinforcing material configured to distribute stresses to maintain a structural integrity of the face, wherein the first portion and the separate piece of reinforcing material together have a combined first thickness;

a second portion having a second perimeter greater than the first perimeter, the second portion in contact with and surrounding the first portion and having a second thickness;

wherein the first thickness is greater than the second thickness, and the second thickness is less than or equal to 0.08 inches; and wherein the first portion comprises no corrugations on a front side of the face.

2. The golf club head of claim 1, wherein the first and second portions are comprised of a first material, and the separate piece of reinforcing material is comprised of a second material different than the first material.

* * * * *